US005636584A

United States Patent [19]

Walker

[11] Patent Number: 5,636,584

[45] Date of Patent: Jun. 10, 1997

[54] LIEF FURLING SYSTEM FOR GATHERING FLEXIBLE MATERIAL

[76] Inventor: Peter J. Walker, 2524 Mapleton Ave., Boulder, Colo. 80304

[21] Appl. No.: 490,229

[22] Filed: Jun. 14, 1995

[51] Int. Cl.[6] ..... B63H 9/04

[52] U.S. Cl. ..... 114/104; 114/105

[58] Field of Search ..... 114/102, 103, 114/104, 105, 39.1, 39.2

[56] References Cited

U.S. PATENT DOCUMENTS

| | | | |
|---|---|---|---|
| 3,310,018 | 3/1967 | Roberts et al. | 114/104 |
| 4,487,147 | 12/1984 | Hoyt | 114/104 |
| 4,606,292 | 8/1986 | Du Temple De Rougemont | 114/104 |
| 5,048,443 | 9/1991 | Brown | 114/104 |

*Primary Examiner*—Stephen Avila

[57] ABSTRACT

A system for gathering cloth, intended for but not limited to sails. A web of vein lines (11) are connected a piece of flexible material in strategic positions depending on the size and cut of the cloth. These vein lines (11) are then lead through the belly button device (18) and joined to the stem line (12). The stem line can be lead to a position where a person will pull it in whenever they want the cloth to be gathered. To gather the cloth the person will pull on the stem line (12) which will pull the vein lines (11) through the belly button device (18) which in turn will pull the cloth connected to the ends of the vein lines (11) towards the belly button device (18). This collects the cloth into a smaller, central location and assists the individual in gathering the material.

21 Claims, 3 Drawing Sheets

LIEF FURLING SYSTEM FOR GATHERING FLEXIBLE MATERIAL

BACKGROUND—FIELD OF INVENTION

This invention is to assist in gathering cloth such as but not limited to sails on sailboats.

BACKGROUND—DISCUSSION OF PRIOR ART

Sailboats often use large off wind sails called spinnakers, asymmetrical spinnakers or gennikers when they are not sailing against the wind. These sails are very large and it can be difficult to lower them and store them.

Historically these sails have required a number of a boats crew to work in concert, both in the front and back of the boat, to lower these large sails and store them. This method is still the most commonly used technique even though it has four disadvantages including; 1) requires a larger number of crew to sail a boat, 2) crew members must leave the safety of the cockpit, 3) shifts crew weight to the front of the boat thereby decreasing the speed of the boat and 4) forces crew to attend to the takedown of the sail instead of concentrating there efforts on other aspects of improving a sailboats performance.

Techniques have been developed in an attempt to simplify the process of lowering and storing off wind sails, however, they carry a number of disadvantageous that tend to outweigh there benefits in the eyes of most sailors.

The first method is the use of a "belly button line". The belly button line is a light weight line that is permanently attached somewhere in the middle of an off wind sail. When lowering the sail this line is pulled in to the waiting crew to help them gather the middle portion of the sail and prevent it from falling in the water. Although using a belly button line is of some assistance it still requires a larger crew who must operate outside of the safety of the cockpit thus taking crew away from other duties and disturbing boat trim.

Another method for storing off wind sails includes the use of a roller furling system. A roller furling system consists of a grooved forestay through which the front of a sail is lead and a rotating drum. When a line from the drum is pulled in it rotates the drum which in turn rolls the sail around the forestay. This method works very well for flatter sails such as jibs, genoas and main sails. However, the very large size and rounded shape of an off wind sail does not allow this system to work effectively for these types of sails. As a result one will rarely see this technique utilized.

Lastly, a system has been developed that uses a large sock which is pulled down over an off wind sail when it is not in use. This system is by far the most common one used and many sail makers such as U.K., Hilde Sails and North Sails offer such a package. However, this system also has its disadvantages. Although one person can "stuff" the sail, by pulling on a line that in turn pulls the sock down over the sail, it still requires two people to remove the sail from the mast and store it down below. One person has to release the halyard, a line used for hoisting sails, while the second moves to the front of the boat to collect the sock as it comes down and put it below. In addition, this method increases weight and windage aloft which serves to decrease the performance of the boat and increase the difficulty of flying an off wind sail in light winds. Finally, the sock system is not aesthetically pleasing because when the sail is in use the sock is crumpled and balled up at the top of the sail. This technique is rarely seen on racing boats because of its appearance and its inablitiy to perform as well as a sail without the sock attachment. Although popular on cruising boats it still requires as person to leave the safety of the cockpit in order to remove the sail from the mast which can be dangerous in adverse conditions.

Each of the above mentioned techniques solve, to a degree, a problematic aspect of lowering and storing off wind sails on a sailboat, however, a single system that effectively solves all four problem areas will be beneficial and is desired by cruising and racing sailors alike.

OBJECTS AND ADVANTAGES

Accordingly, several advantages of my invention are:

(a) the ability for one person to lower and store off wind sails;

(b) the ability to lower and store these off wind sails from the cockpit of the sail boat;

(c) thereby maintaining proper boat trim throughout the lowering and storing maneuver;

(d) my system allows other crew, who would otherwise be involved in the takedown of the sail, to focus on other aspects of the boats performance;

Further objects and advantages include the need for a smaller crew which serves to reduce weight on the boat. In addition, when fewer crew are needed, it increases the ease of organizing and maintaining a team who will work better together. Also, many of the newer boats being manufactured today are designed for a crew of three or four people versus the seven, eight or nine required on older designs; as a result there is a need to simplify crew functions. My invention satisfies all of these needs. My invention is also more efficient with decreased weight and windage aloft and is more aesthetically pleasing because the need for a sock type system is eliminated. My invention can also be effectively used on smaller sailboats of all types, whether they be monohulls or multihulls, where present systems are to weighty and cumbersome to be used effectively. Finally, the simplicity of construction and very low cost of my invention will be attractive to all sailors on monohulls, multihulls, small boats or large boats. My invention solves the four problem areas involved in lowering and storing off wind sails that prior art forms have not been able to adequately cure as well as providing a number of other advantages. Further objects and advantages of my invention will become apparent from a consideration of the drawings and ensuing description.

DRAWING FIGURES

In the drawings, closely related figures have the same numbers but different alphabetical suffixes.

Figure 6A:
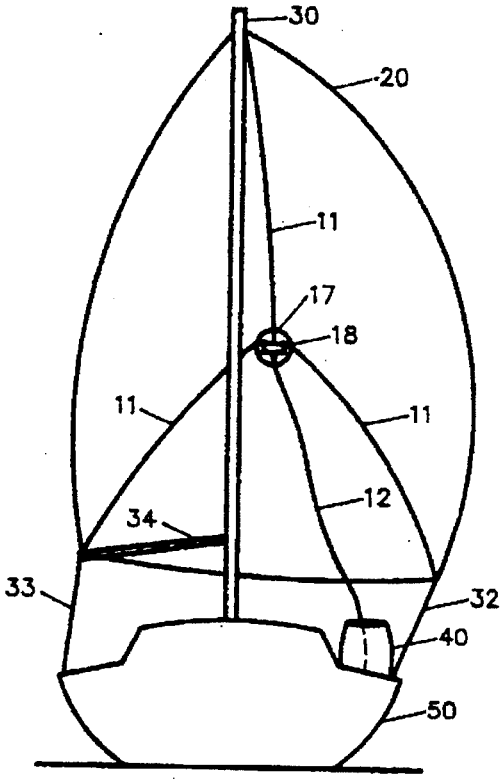
Figure 6B:
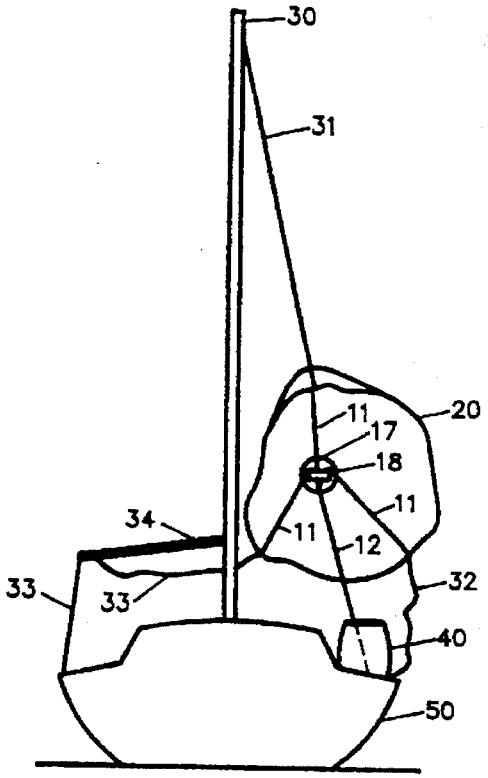
Figure 6C:
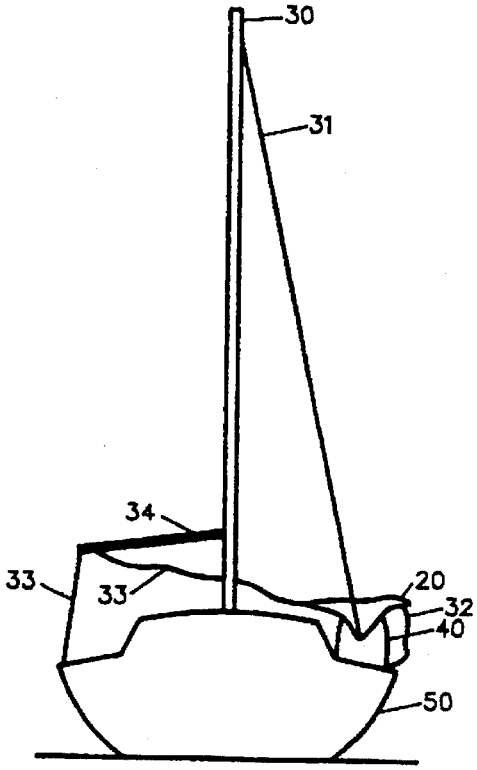

FIG. 6*a* through 6*c* show in various stages the takedown and storing of an off wind sail using my invention.

Figure 7:
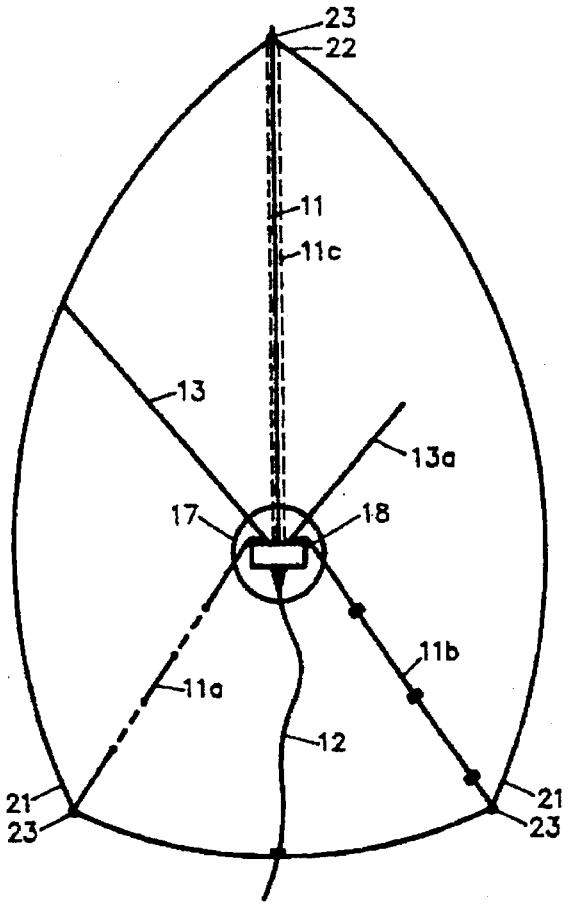

FIG. 7 shows some of the variations and ramifications that can be used with my invention relating to the vein lines, more of which are discussed in the ramifications section of the written patent.

Figure 7A:
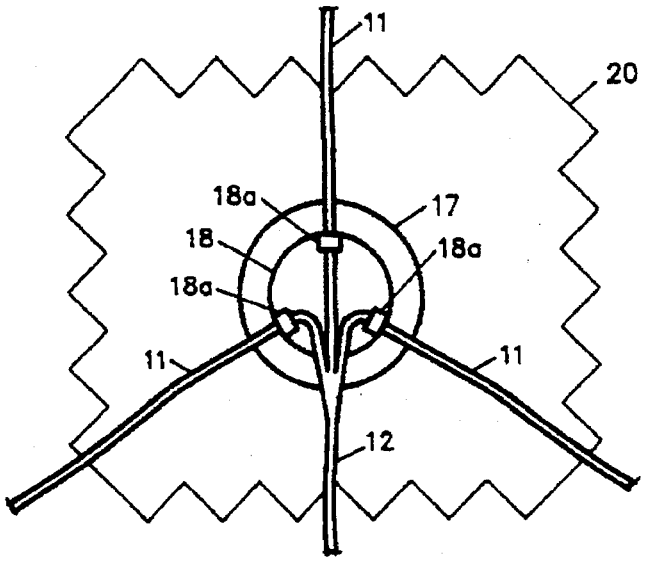

FIG. 7*a* is one example of an alternate belly button device that can be used with my invention.

REFERENCE NUMERALS IN DRAWINGS

11 vein lines
12 stem line
21 clews (lower corners of sail)
23 rings (for attaching lines to sail)
13 additional vein lines
25 reinforced sail cloth
30 mast
31 spinnaker halyard
32 sheet
33 guy

Description of Figs. 1 Through 6

Figure 1:
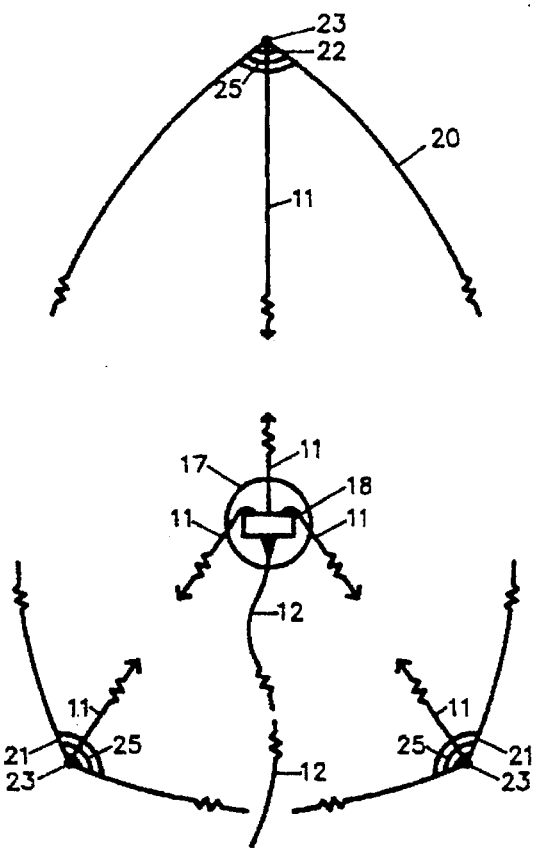
FIG. 1 shows the three corners of an off wind sail, the clews (lower corners) and the head (top corner) and where the vein lines can be attached to the sail.

FIG. 1 shows a segmented off wind sail with clews 21 and head 22. The figure also shows where the vein lines 11 of my invention can be attached to the clews 21 and head 22 of the sail and then lead to the belly button device 18 which will be located strategically on the off wind sail depending on the type and cut of an individual sail. This figure shows the vein lines 11 secured to the rings 23 at the corners of the sail but this is only one of many possible methods of attachment as is discussed in the ramifications section.

Figure 2:
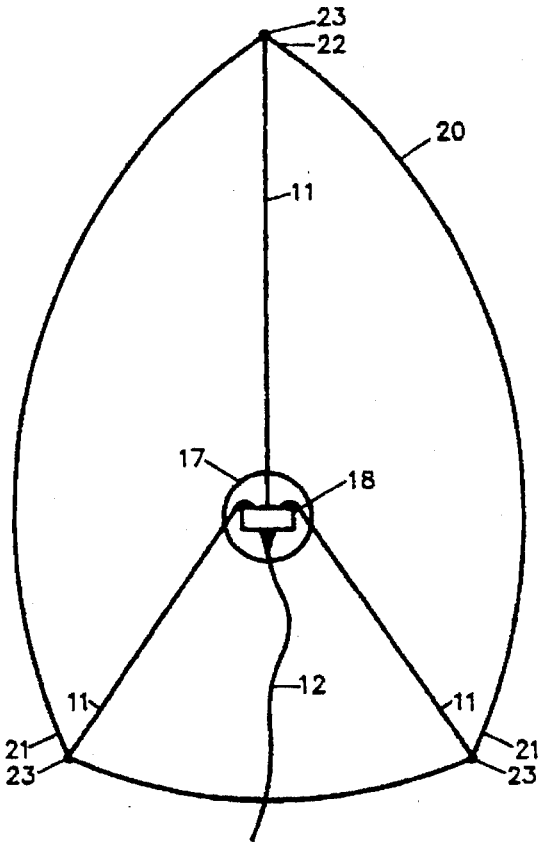
FIG. 2 shows an off wind sail fitted with the various components that allow the system to work.

FIG. 2 shows how an off wind sail fitted with my invention will look from behind when the sail is full and in its normal sailing position. The vein lines 11 are attached at the corners of the sail 21,22 and then lead to the belly button device 18. Then, the vein lines 11 are lead through the belly button device 18 and connected to the stem line 12.

Figure 3:
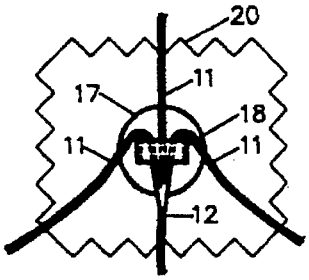
FIG. 3 shows the belly button, belly button device, vein lines, and stem line as it is viewed from the inside of an off wind sail when the sail is full and in its normal sailing position.

FIG. 3 is of the belly button 17 and belly button device 18 as it is seen from behind when the off wind sail is full and in its normal sailing position. The belly button 17 is simply a reinforced patch that is connected to the sail. On some sails this reinforcement may not even be necessary. The belly button device 18 in the diagram is shown as a ring attached to the belly button 17 however, anything that can be attached to the sail and will allow the vein lines 11 to pass through it will be effective. This diagram also shows only one of the ways that the vein lines 11 can be lead through the belly button device 18 and then connect to the stem line 12. Alternative methods are discussed in the ramifications segment.

Figure 4:
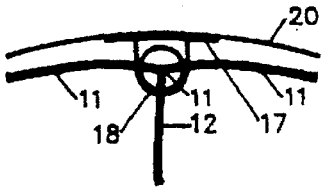
FIG. 4 is a top view of the belly button, belly button device, vein lines and stem line on an off wind sail when the sail is full and in its normal sailing position.

FIG. 4 is a view of the belly button 17 and belly button device 18 arrangement as seen from the top when the off wind sail is full and in its normal sailing position. This diagram again shows the vein lines 11 first being lead through the belly button device 18 and then being connected to the stem line 12. This drawing also shows the belly button 17 and how it serves to reinforce the sail against the additional pressures added to this portion of the sail by my invention. Not depicted in the diagram is the connection of the vein lines 11 to the clews 21 and head 22 of the sail.

Figure 5:
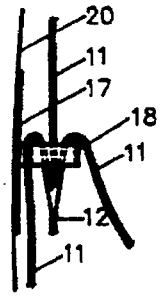
FIG. 5 is a side view of the belly button belly button device, vein lines and stem line when viewed from the side of an off wind sail when the sail is full and in its normal sailing position.

FIG. 5 is a view of the belly button 17 and belly button device 18 arrangement from the side when the off wind sail is full and in normal sailing position. Again, the diagram shows the belly button 17 acting as a reinforcement for the sail to prevent it from tearing. Also depicted in the drawing is the vein lines 11, stem line 12 and sail 20.

Operation FIGS. 6*a* Through 6*c*

FIG. 6*a* is a rear view of a sailboat sailing with an off wind sail. Other sails such as the main or jib that would normally be used when sailing off the wind have not been included in the following drawings to make it easier to see how my invention works. In this diagram the boat is preparing to take the sail down and store it in the sail bag 40. The stem line 12 and vein lines 11 do not have any tension on them which allows the sail to fill with wind to its proper shape. The stem line 12 is lead from the belly button device 18 through the top of the sail bag and then through a small opening in the bottom of the bag. Another alternative is to lead the stem line 12 through a hatch in the deck; the stem line is lead to wherever the sail is to be stored and then to a crew member whose job is to pull the stem line 12 in during the take down.

FIG. 6*b* is a rear view of a sailboat that is in the middle of the take down procedure. As the spinnaker halyard 31, spinnaker sheet 32 and spinnaker guy 33 (lines that control shape of an off wind sail) are eased the stem line 12 is pulled in. This pulls the vein lines 11 toward the belly button 17 and through the belly button device 18 thereby pulling the outer edges of the sail into the middle portion of the sail. Once the corners of the sail 21, 22 meet at the belly button device 18 the tension on the stem line 12 will pull the sail downward toward the sail bag or hatch depending on where the stem line 12 is lead.

FIG. 6*c* is of the sailboat at the end of the takedown maneuver. The belly button device 18 (which in most cases is located at the bulkiest portion of the sail) is pulled to the bottom of the sail bag with the rest of the sail pulled in behind it.

FIG. 7 shows a few examples of different ways to lead the vein lines 11 from their point of attachment to the sail 20 to the belly button device 18. 11*a* show a vein line 11 that is lead from the clew 21 of the sail 20 through a number of grommets so that the vein line 11 runs for a distance on the inside of the sail 20, goes through a grommet and then runs on the outside of the sail 20 for a distance before coming back to the inside of the sail 20 ect., on its way to the belly button device 18.

11*b* show a vein line 11 being lead from the clew 21 through a plurality of rings which are attached to the sail 20 on its way to the belly button device 18.

11*c* shows a vein line 11 that is attached to the head 22 of the sail 20 and runs directly to the belly button device 18 however sail cloth is sewn over the vein line 11.

13 shows a vein line 11 that is not connected to a corner of the sail 20. This is intended to show that the vein lines 11 can be lead to any point on the sail 20.

13*a* shows a vein line 11 that is lead to a central portion of the sail 20. Again, it is intended to show that vein lines 11 can be attached to the sail 20 at any point.

FIG. 7*a* is one example of an alternate belly button device 18. This version of the belly button device 18 shows a device that has individual loops 18*a* through which the vein lines 11 are lead before being connected to the stem line 12.

Summary, Ramifications, and Scope

Accordingly, the reader can see how this system for lowering and storing off wind sails has significant advantages over prior art forms. The system is very light weight, inexpensive and easy to manufacture. In addition, sailboats that choose to use this system will be able to lower and store sails with fewer crew who can perform the task from the safety of the cockpit while maintaining proper boat trim throughout the maneuver.

Although the description above contains many specificities, these should not be construed as limiting the scope of the invention but as merely providing illustrations of some of the presently preferred embodiments of this invention. For example, the vein lines 11 can be secured to any point on a sail. Also, the vein lines 11 can be of different lengths. In addition they can be attached to the sail in a plurality of ways; they can be tied to the rings at the corners of the sail, they can be sewn to the sail, they can be molded into the sail ect. ect. Also, the vein lines 11 can be lead to the belly button device 18 in many different ways as is drawn in FIG. 7.

Other ramifications pertain to the belly button 17 and belly button device 18. The belly button 17 is simply to reinforce the sail and prevent the sail from ripping due to the added stress involved with my system. It can be made of any material in any shape, size of color. In many cases the belly button can be eliminated altogether.

The belly button device 18 can be made of any material in any size shape, color or configuration as long as it serves to gather the vein lines 11 to a certain portion of the sail. One example of another form the belly button device can take is shown in FIG. *7a*.

It is the inventors intention to secure a patent and gain offensive rights for the idea of using a "web" of lines, which radiate and contract from a strategic point, in order to lower and store off wind sails whether they be spinnakers, asymmetrical spinnakers, gennikers, bloopers ect.ect. Thus the scope of the invention should be determined by the appended claims and their legal equivalents, rather than by the examples given.

I claim:

1. A sail furling system on a boat for gathering an off wind sail having a sail head and a plurality of clews, the off wind sail being hung from but not supported by, a mast on the boat, comprising:

a belly button located on the off wind sail;

a loop connected to the said belly button;

first, second, and third vein lines, wherein said first vein line includes a first end and a second end and said first end of said first vein line is connected to a first clew of the plurality of clews on the off wind sail, said second vein line includes a first end and a second end and said first end of said second vein line is connected to a second clew of the plurality of clews on the off wind sail, and said third vein line includes a first end and a second end and said first end of said third vein line is connected to the sail head of the off wind sail, further wherein said second ends of said first, second, and third vein lines are joined together to form a juncture; and a stem line having a first end and a second end, wherein said first end is connected to said juncture and said stem line extends from said juncture through said loop such that when said second end of said stem line is pulled, said first, second, and third vein lines are drawn toward said loop.

2. The said furling system of claim 1, including first attachment means attached to the off wind sail between said juncture and the first clew of the plurality of clews on the off wind sail, wherein the said first vein line extends through said first attachment means.

3. The sail furling system of claim 2, including second attachment means attached to the off wind sail between said juncture and the second clew of the plurality of clews on the off wind sail, wherein said second vein line extends through said second attachment means.

4. The sail furling system of claim 1, including third attachment means attached to the off wind sail between the sail head of the off wind sail and said juncture, wherein said third vein line extends through said third attachment means.

5. The sail furling system of claim 1, including a fourth vein line having a first end and a second end, wherein said first end of said fourth vein line is connected to the off wind sail and said second end of said fourth vein line is connected to said juncture.

6. The sail furling system of claim 5, wherein said first end of said fourth vein line is not connected to the sail head of the off wind sail and is not connected to any of the plurality of clews on the off Wind sail.

7. The sail furling system of claim 1, including a plurality of vein lines in addition to said first, second, and third vein lines, wherein each of said plurality of vein lines has a first end connected to the off wind sail and a second end connected to said juncture.

8. The sail furling system of claim 1, including a sail containment means located on the boat through which said stem line extends, such that when said stem line is pulled, said first, second, and third vein lines and the off wind sail are drawn into said sail containment means.

9. The sail furling system of claim 8, wherein said sail containment means includes a sail bag.

10. A sail furling system on a boat for gathering an off wind sail having a sail head and a plurality of clews, comprising:

first, second, and third vein lines, wherein said first vein line includes a first end and a second end and said first end of said first vein line is connected to a first clew of the plurality of clews on the off wind sail, said second vein line includes a first end and a second end and said first end of said second vein line is connected to a second clew of the plurality of clews on the off wind sail, and said third vein line a first end and a second end and said first end of said third vein line is connected to the sail head of the off wind sail, further wherein said second ends of said first, second, and third vein lines are joined together to form a juncture;

loop means connected to the off wind sail for retaining at least a portion of each said first, second, and third vein lines in substantial proximity to the off wind sail, wherein said first, second, and third vein lines extend through said loop means; and a stem line having a first end and a second end, wherein said first end is connected to said juncture and said stem line extends from said juncture such that when said second end of said stem line is pulled, said first, second, and third vein lines are drawn through said loop means.

11. The sail furling system of claim 10, wherein said loop means includes a first, second, and third loop connected to the off wind sail such that said first vein line extends through said first loop, said second vein line extends through said second loop, and said third vein line extends through said third loop.

12. The sail furling system of claim 11, wherein at least one of said first, second, and third loops is perpendicular to the off wind sail.

13. The sail furling system of claim 11, wherein said loop means includes at least one grommet positioned in the off wind sail between said third loop and the sail head of the off wind sail and said third vein line extends through said ring.

14. The sail furling system of claim 11, wherein said loop means includes at least one ring connected to the off wind sail between said third loop and the sail head of the off wind sail and said vein line extends through said ring.

15. The sail furling system of claim 11, wherein said loop means includes at least one grommet positioned in the off wind sail between said first loop and the first clew of the plurality of clews on the off wind sail and said first vein line extends through said grommet.

16. The sail furling system of claim 11, wherein said loop means includes at least one ring connected to the off wind sail between said first loop and the first clew of the plurality of clews on the off wind sail and said first vein line extends through said ring.

17. The sail furling system of claim 10, including a sail containment means located on the boat through which said stem line extends, such that when said stem line is pulled, said first, second, and third vein lines and the off wind sail are drawn into the said sail containment means.

18. The sail furling system of claim 10, including a fourth vein line having a first end and a second end, wherein said first end of said fourth vein line is connected to the off wind sail, said second end of said fourth vein line is connected to said juncture, and said fourth vein line extends through said loop means.

19. The sail furling system of claim 18, wherein said first end of said fourth vein line is not connected to the sail head makes of the off wind sail and is not connected to any plurality point of clews on the off wind sail.

20. The sail furling system of claim 10, including a plurality of vein lines in addition to said first, second, and third vein lines, wherein each of said plurality of vein lines has a first end connected to the off wind sail, a second end connected to said juncture, and each of said plurality of vein lines extends through said loop means.

21. A sail furling system on a boat for gathering an off wind sail having a sail head and a plurality of clews, comprising:

first, second, and third vein lines, wherein the first vein line includes a first end and a second end and said first end of said first vein line is connected to a first clew of the plurality of clews on the off wind sail, said second vein line includes a first end and a second end and said first end of said vein line is connected to a second of the plurality of clews on the off wind sail, and said third vein line includes a first end and a second end and said first end of said third vein line is connected to the sail head of the off wind sail, further wherein said second ends of said first, second, and third vein lines are joined together to form a juncture;

a loop connected to the off wind sail; and a stem line having a first end and a second end, wherein said first end is connected to said juncture and said stem line extends from said juncture through said loop such that when said second end of said stem line is pulled, said first, second, and third vein lines are drawn through said loop.

* * * * *